US008455761B2

(12) United States Patent
Hayashishita et al.

(10) Patent No.: US 8,455,761 B2
(45) Date of Patent: Jun. 4, 2013

(54) COAXIAL CABLE AND MULTICOAXIAL CABLE

(75) Inventors: Tatsunori Hayashishita, Aomori (JP); Hirokazu Takahashi, Aomori (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 153 days.

(21) Appl. No.: 12/682,437

(22) PCT Filed: Sep. 24, 2009

(86) PCT No.: PCT/JP2009/066563

§ 371 (c)(1),
(2), (4) Date: Jun. 21, 2010

(87) PCT Pub. No.: WO2010/035762

PCT Pub. Date: Apr. 1, 2010

(65) Prior Publication Data

US 2010/0288529 A1 Nov. 18, 2010

(30) Foreign Application Priority Data

Sep. 24, 2008 (JP) ..... P2008-244033

(51) Int. Cl.
*H01B 7/00* (2006.01)

(52) U.S. Cl.
USPC ..... 174/110 R; 174/113 R

(58) Field of Classification Search
USPC ..... 174/110 R, 110 F, 102 R, 113 AS, 174/113 R
See application file for complete search history.

(56) References Cited

U.S. PATENT DOCUMENTS

| | | | | |
|---|---|---|---|---|
| 4,293,903 | A * | 10/1981 | Mochida et al. | 363/68 |
| 5,442,131 | A * | 8/1995 | Borgwarth | 174/15.6 |
| 6,751,855 | B2 * | 6/2004 | Matsui et al. | 29/825 |
| 2005/0230145 | A1 | 10/2005 | Ishii et al. | |
| 2007/0098940 | A1 * | 5/2007 | Heffner | 428/36.9 |
| 2007/0187134 | A1 * | 8/2007 | Detian et al. | 174/126.1 |

FOREIGN PATENT DOCUMENTS

| | | | |
|---|---|---|---|
| FR | 2735606 | A1 | 12/1996 |
| JP | 9-120717 | | 5/1997 |
| JP | 2001-160325 | A | 6/2001 |
| JP | 2003-249129 | | 9/2003 |
| JP | 2004-119060 | A | 4/2004 |
| JP | 2007-12383 | A | 1/2007 |
| JP | 2007-335393 | | 12/2007 |
| JP | 2008-103179 | | 8/2008 |

OTHER PUBLICATIONS

Machine translation of JP-09120717 published May 1997.*

(Continued)

*Primary Examiner* — Chau Nguyen
(74) *Attorney, Agent, or Firm* — McDermott Will & Emery LLP

(57) ABSTRACT

A coaxial cable includes an insulator having void portions continuing in a longitudinal direction, a central conductor covered with the insulator, and an outer conductor arranged on an outer circumference of the insulator. Each of the void portions is formed to have a circular or elliptical cross section, and the void portions are evenly arranged in the insulator in a set of six to nine. In a cross section perpendicular to the longitudinal direction of the coaxial cable, a void ratio of the entire void portions is 43% or more. The void ratio is a proportion of the void portions to a sum of a total area of all the void portions and an area of the insulator.

6 Claims, 3 Drawing Sheets

OTHER PUBLICATIONS

Japanese Office Action, and English translation thereof, issued in Japanese Patent Application No. 2008-244033 dated Jul. 17, 2012.

Extended European Search Report issued in the counterpart EP Application No. 09816177.1, mailed on Jan. 7, 2013.

* cited by examiner (A)

(B)

COAXIAL CABLE AND MULTICOAXIAL CABLE

RELATED APPLICATIONS

This application is the U.S. National Phase under 35 U.S.C. §371 of International Application No. PCT/JP2009/066563, filed on Sep. 24, 2009, which in turn claims the benefit of Japanese Application No. 2008-244033, filed on Sep. 24, 2008, the disclosures of which Applications are incorporated by reference herein.

TECHNICAL FIELD

The present invention relates to a coaxial cable and a multicoaxial cable which are used for wiring etc. in telecommunication devices and information devices.

BACKGROUND ART

Coaxial cables are used for wiring inside or between electronic devices and for transmission of high-speed signals. Generally, such coaxial cables have a structure in which a central conductor is covered with an insulator, an outer circumference of the insulator is covered with an outer conductor, and an outer side thereof is covered with a protective jacket, and an outer diameter of the cable varies from 0.25 mm to several millimeters depending on use. For such coaxial cables to obtain good electrical properties with a small diameter, it is considered important that the insulator with which the outer circumference of the central conductor is covered have as low permittivity as possible.

Conventionally, resins having low permittivity, such as a fluororesin and a polyolefin resin, are used as the insulator of coaxial cables. To further lower its permittivity, in some cases, the insulator to be used is foamed by gas foaming, chemical foaming or the like. However, it is difficult to stabilize a shape during an insulator coating by a foaming extrusion, which is likely to result in a fluctuation in an outer diameter of the insulator. Further, as an extent of foaming is increased, a foamed condition becomes likely to be deteriorated, which degrades stability of longitudinal transmission characteristics and the like. Furthermore, the adhesion strength of a foamed insulator to a conductor is low.

On the other hand, as shown in (A) of FIG. 2, there is known a coaxial cable having a structure in which a plurality of hollow portions are formed along a longitudinal direction of an insulator (see, e.g., Patent document 1). In this coaxial cable 1*a*, the insulator 3 for a central conductor 2 has a configuration in which an inside annular body 3*a* adhered to the central conductor 2 and an outside annular body 3*b*, on which an outer conductor 5 is wound, are connected to each other via a plurality of ribs 3*c* such that the plurality of hollow portions 4, each having a fan-shaped cross section, are provided. The hollow portions 4 occupy 40% or more of the insulator 3. An outer circumference of the outer conductor 5 is covered with a protective jacket 6, whereby the entire cable is protected.

Further, as shown in (B) of FIG. 2, there is known a differential transmission cable 1*b* having a structure in which an insulator 7, which insulates a central conductor 2*a*, is formed with a plurality of void portions 8 along a longitudinal direction (see, e.g., Patent document 2). In this differential transmission cable 1*b*, the insulator 7 surrounding the central conductor 2*a* has a configuration in which six void portions 8, each having an elliptical cross section, are evenly arranged around the central conductor 2*a*. A pair of signal lines, each having the central conductor 2*a* insulated with the insulator 7, is shielded by an outer conductor 5*a* together with a drain wire 9, and the outer circumference thereof is covered with a protective jacket 6*a*.

PRIOR ART DOCUMENTS

Patent Documents

Patent document 1: JP 2007-335393 A
Patent document 2: JP 2008-103179 A

SUMMARY OF INVENTION

Problems to be Solved by the Invention

The fan-shaped cross section of each of the hollow portions (void portions) of the coaxial cable shown in (A) of FIG. 2 allows the void portions to occupy a large part of the insulator, however, sufficient strength against external pressure cannot be ensured. Therefore, the cable is likely to collapse and there is a problem that the void portions are likely deform in response to bending and, thus, it is difficult to ensure stability of transmission characteristics in actual use. Even in a case in which the cross section of each of the void portions is made elliptical or circular like the coaxial cable of (B) of FIG. 2, when a cross-sectional area of each of the void portions is excessively large, a thickness of the insulator around the void portions becomes thin, which makes it difficult to ensure sufficient strength. On the other hand, the strength can be ensured by reducing the cross-sectional area of each of the void portions. However, this reduces the proportion of the entire void portions to the insulator, which makes the permittivity of the insulator higher. As a result, electrical properties and dimensions of the cable do not fall within prescribed ranges.

It is an object of the present invention to provide a coaxial cable and a multicoaxial cable, in which permittivity is made low by ensuring a proportion of void portions to an insulator and in which sufficient strength is obtained.

Means for Solving the Problems

A coaxial cable according to the present invention is a coaxial cable in which a central conductor is covered with an insulator having void portions continuing in a longitudinal direction, and an outer conductor is arranged on an outer circumference of the insulator, and is characterized in that:

each of the void portions is formed to have a circular or elliptical cross section, the void portions are evenly arranged in the insulator in a set of six to nine, and, in a cross section perpendicular to the longitudinal direction of the coaxial cable, a void ratio of the entire void portions is 43% or more, the void ratio being a proportion of the void portions to a sum of a total area of all the void portions and an area of the insulator.

It is preferable that the void portions be arranged in a set of seven to nine, and that the void ratio of each of the void portions be 6.8% or less.

It is preferable that the number of the void portions is eight, and that the void ratio of the insulator be 43% to 54%.

It is preferable that a ratio of a diameter of the insulator to a ratio of the central conductor be 2.4 to 2.7.

It is preferable that a ratio of the diameter of the insulator to the diameter of the central conductor be 3.2 to 4.0, and that the number of the void portions is six, the void ratio of each of the void portions being 9.0 to 10%.

Further, a multicoaxial cable may be provided by incorporating a plurality of the coaxial cables described above.

Advantages of the Invention

According to the present invention, it is possible to lower the permittivity by ensuring the proportion of the void portions to the insulator, to make it less likely to collapse in response to bending or external pressure, and to ensure stable transmission characteristics.

EMBODIMENTS OF THE INVENTION

Figure 1:
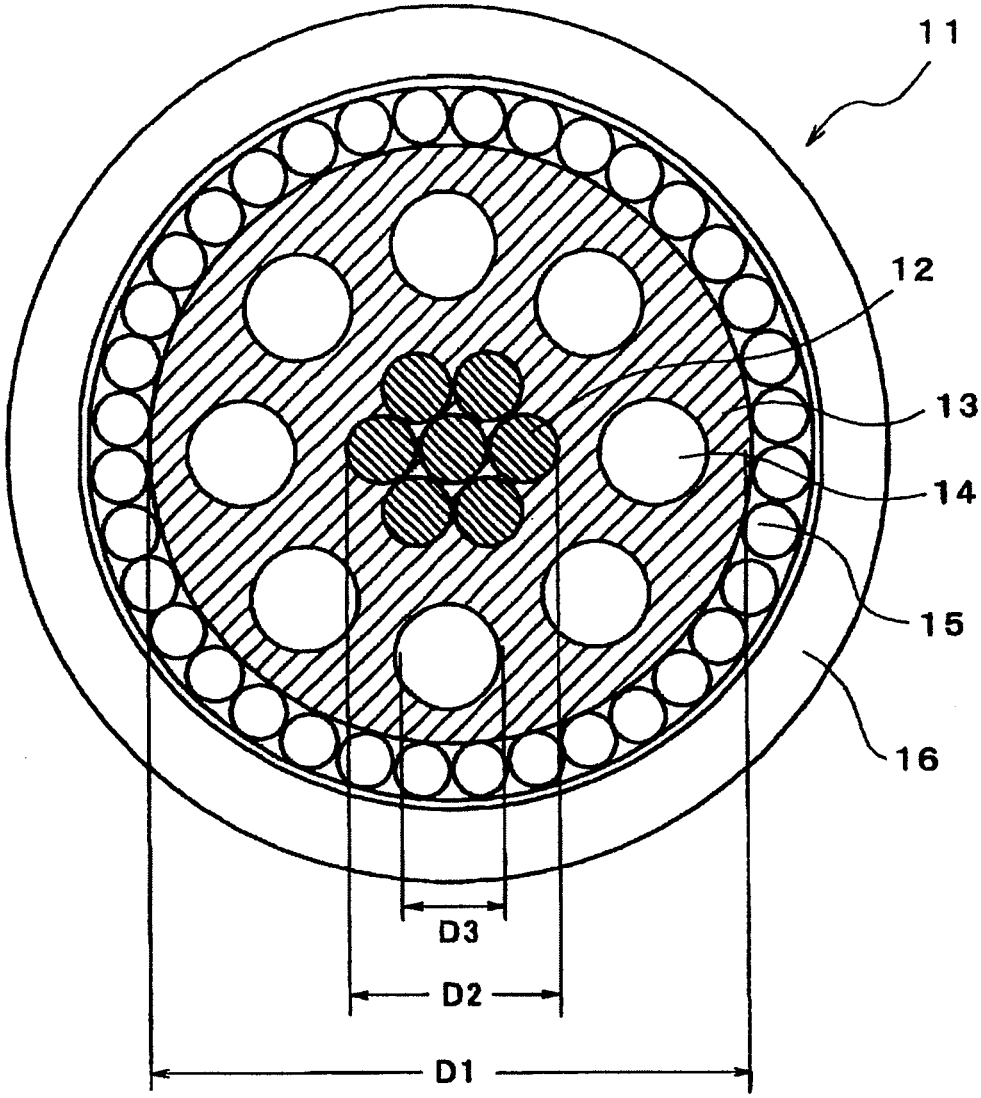
FIG. 1 is a diagram illustrating an example of an embodiment of the present invention.

FIG. 1 is an example of an embodiment of a coaxial cable according to the present invention. In FIG. 1, 11 denotes a coaxial cable, 12 denotes a central conductor; 13 denotes an insulator, 14 denotes void portions, 15 denotes an outer conductor, and 16 denotes a jacket.

The coaxial cable 11 according to the embodiment has a configuration in which the central conductor 12 is covered with the insulator 13, the outer conductor 15 is arranged on the outer circumference of the insulator 13, and an outer side thereof is protected by the jacket 16. The insulator 13 has a plurality of void portions 14 continuing in a longitudinal direction. The central conductor 12 and the insulator 13 as well as the outer conductor 15 and the insulator 13 are firmly adhered without a gap therebetween.

The central conductor 12 is formed from a single wire or a stranded wire made of a silver-coated or tin-coated annealed copper wire or a copper alloy wire. In the case of stranded wire, for example, one having an outer diameter of 0.075 mm (equivalent to AWG (American wire gauge) #42) by twisting seven strand conductors, each having a diameter of 0.025 mm, or one having an outer diameter of 0.38 mm (equivalent to AWG #28) by twisting seven strand conductors, each having a diameter of 0.127 mm, may be used.

The outer conductor 15 is formed by arranging a bare copper wire (an annealed copper wire or a copper alloy wire), a silver-coated or tin-coated annealed copper wire, or a copper alloy wire, which is approximately the same in thickness as the strand conductors used in the central conductor 12, on the outer circumference of the insulator 13 in a spirally-wound or braided structure. Further, in order to improve shielding performance, as shown as a layer directly on an outer side of the outer conductor 15 in FIG. 1, a metal foil tape may also be provided. The jacket 16 is formed by extruding a resin material such as fluororesin or by winding a resin tape such as a polyester tape.

The insulator 13 is formed by extrusion, using a thermoplastic resin such as polyethylene (PE) having a Young's modulus of 400 to 1,300 MPa, polypropylene (PP) having a Young's modulus of 1,500 to 2,000 MPa, or fluororesin having a Young's modulus of about 500 MPa. As fluororesin material, for example, PFA (tetrafluoroethylene-perfluoroalkylvinylether copolymer), FEP (tetrafluoroethylene-hexafluoropropylene copolymer), ETFE (tetrafluoroethylene-ethylene copolymer), etc. may be used.

It is desirable that, when D2 is defined as the conductor diameter of the central conductor 12, the outer diameter D1 of the insulator 13 be about D2×(2.2 to 3.0). For example, in a case in which the conductor diameter of the central conductor 12 is 0.38 mm (AWG #28), the outer diameter of the insulator 13 is 0.84 mm to 1.1 mm. When the conductor diameter of a wire of the central conductor 12 is smaller than AWG #42, capacitance of the insulator 13 is required to be small (e.g., 60 pF/m or less). In such a case, it is desirable that the outer diameter D1 of the insulator 13 be D2×(2.2 to 3.6). For example, in a case in which the conductor diameter of the central conductor 12 is 0.075 mm, the outer diameter of the insulator 13 is 0.17 mm to 0.27 mm. The present invention is directed to a coaxial cable which is formed such that the outer diameter of the insulator 13 is 1.1 mm or less.

Coaxial cables having such a dimension are often used, in mobile phones and notebook personal computers, as a wiring or the like for connecting an antenna line or an LCD (liquid crystal display) and a CPU (central processing unit), or as a multicoaxial cable for connecting sensors and devices. In accordance with a reduction in size and thickness of such terminal apparatuses, coaxial cables and multi-core cables are required to be reduced in their diameters. Coaxial cables are required to have a prescribed impedance (50Ω, 75Ω, or 80 to 90Ω), and within a range in which this requirement is met, the diameter is made as small as possible. To this end, it is necessary to reduce the permittivity of the insulating layer between the central conductor 12 and the outer conductor 15. In the present invention, the void portions 14 are provided in the insulator 13, and the total void ratio of all the void portions 14 is 43% or more, whereby the diameter is reduced within the dimensional range described above. If an attempt is made to reduce the diameter with the total void ratio being smaller than 43%, it is difficult to make the impedance of a coaxial cable have the prescribed values.

In a case in which the outer diameter D1 of the insulator 13 of the coaxial cable according to the present invention is D2×(2.4 to 2.7), it is a small diameter and the insulator 13 is thin. Thus, it may not be able to withstand external pressure or bending applied to the cable. Therefore, as for the thin coaxial cables to which the present invention is directed, a size of each of the void portions 14 provided in the insulator 13 becomes an issue. Coaxial cables having a larger diameter are free of this issue. In this embodiment, a sufficient durability is realized in the coaxial cable having this dimension by setting the void ratio per one void portion 6.8% or less.

It is desirable that each of the void portions 14 of the insulator 13 be formed to have a circular (true circular, elliptical) cross section, and that seven to nine void portions be provided so as to be evenly arranged around the central conductor 12. Where each of the void portions 14 is formed to be, for example, a substantially true circle, and an inner diameter thereof is defined as D3, it is preferable that the proportion of each of the void portions 14 to the insulator 13 be in the following range.

$$0.068 \geqq (\{D3/2\}^2 \times \pi)/(\{D1/2\}^2 \times \pi - \{D2/2\}^2 \times \pi)$$

The concept of the expression described above is likewise applicable to the elliptical void portions 14. That is, it is desirable that the void ratio of each of the void portions 14 be 6.8% or less to satisfy the strength of the void portions 14 themselves. If the void ratio of each of the void portions 14 is too small, the prescribed void ratio cannot be obtained and the low permittivity cannot be ensured. The void ratio of the void portions 14 in total in set to be 43% or more. In a case in which a set of seven voids are provided, the void ratio per each is 6.1% or more. In a case in which a set of eight voids are provided, the void ratio per each is 5.4% or more. In a case in which a set of nine voids are provided, the void ratio per each is 4.8% or more. The term "elliptical" does not necessarily be a shape of ellipse in the mathematical sense, and encompasses shapes of distorted circles.

The total void ratio is 43% to 47.6% in the case in which the number of the void portions 14 provided in the insulator 13 is seven, and is 43% to 54.4% in the case in which it is eight, and is 43% to 61.2% in the case in which it is nine. According to this, low permittivity for the prescribed impedance can be ensured. Further, because the void ratio of each of the void portions 14 is 6.8% or less, the mechanical strength of the insulator 13 as a whole is increased, whereby it becomes less likely to collapse in response to external pressure or bending and the stable transmission characteristics can be ensured.

In the case in which the number of the void portions 14 is eight, and when the conductor diameter D2 of the central conductor 12 is 0.38 mm, the outer diameter D1 of the insulator 13 is 0.96 mm, and the inner diameter D3 of the void portions 14 is 0.225 mm, the void ratio of the insulator 13 becomes 52%. In addition to this, when a coated annealed copper wire having an outer diameter of 0.127 mm is wound as the outer conductor 15 and is covered with an extruded fluororesin (e.g., PFA) of about 0.04 mm in thickness as the jacket 16, a coaxial cable having an outer diameter of 1.3 mm can be obtained.

Figure 2:
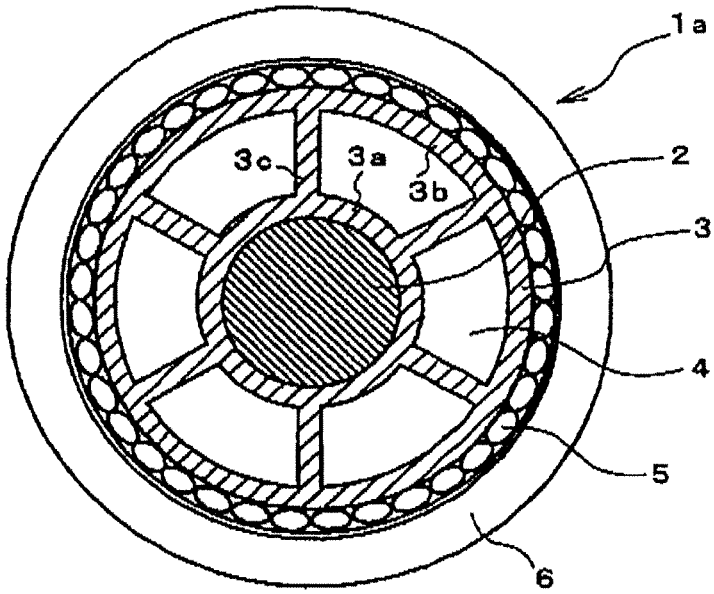
FIG. 2 Prior Art
FIG. 2 is a diagram illustrating conventional art.
Figure 2:
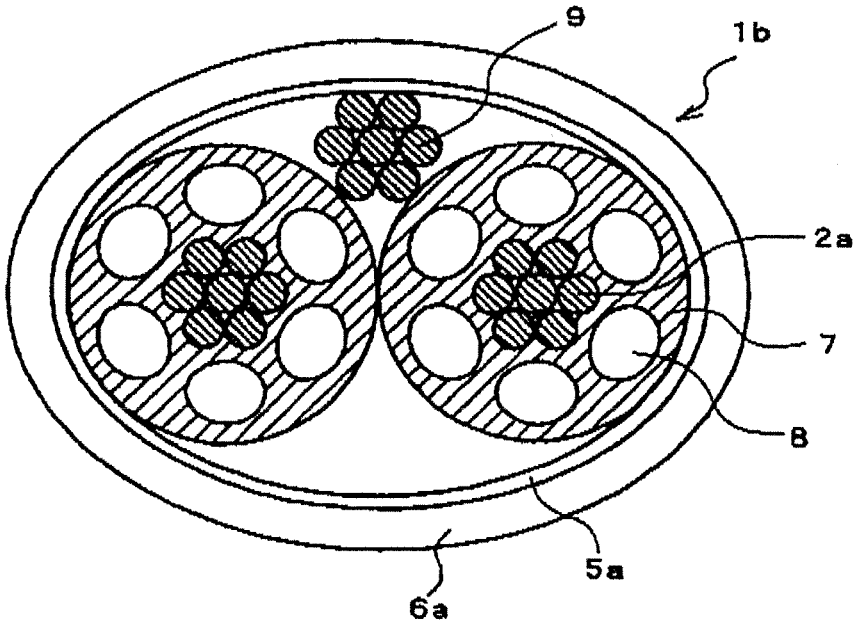
FIG. 2 Prior Art

In a case in which the number of the void portions provided in the insulator is six, as shown in (B) of FIG. 2, the void ratio of each of the void portions becomes 7.2% or more in order to ensure the same level of void ratio described above, and if D1/D2 is 2.4 to 2.7, it becomes likely to collapse in response to external pressure or bending. In a case in which the number of the void portions is ten or more, the diameter of each of the void portions becomes small and the total void ratio may become small. When a prescribed range is given to the total void ratio, the strength of the insulator may be lowered due to, for example, a generation of a thin part of the insulator between the void portions. In this case, it becomes likely to collapse in response to external pressure or bending.

In a case in which D1/D2 is 3.2 to 4.0 and capacitance of the insulator is 60 pF/m or less, it is preferable that the void ratio of all the void portions be 54% or more. As shown in Examples 3 and 4 which will be described later, when a stranded wire in which seven silver-coated silver-copper alloy strands of 0.025 mm in outer diameter (equivalent to AWG #42) are twisted is used as the central conductor and when the void ratio of all the void portions is 54%, the capacitance of the coaxial cable was made to be 60 pF/m. In order to realize this void ratio, a set of six void portions may be provided. Since the insulator is somewhat thicker relative to the diameter of the central conductor 12 as D1/D2 being 3.2 to 4.0, it is necessary to set the void ratio of all the void portions 14 somewhat higher in order to obtain the capacitance of 60 pF/m or more. In this case, if the number of void portions more than seven, the insulator becomes thin between the void portions, and as a result, when an external force is applied, the portion between the void portions may break and the insulator may collapse. If the number of void portions is six, it is possible to ensure thickness of the insulator between the void portions while maintaining the void ratio that realizes the capacitance of 60 pF/m less. This prevents the insulator from being collapsed even when a force is applied on the coaxial cable when, for example, winding the coaxial cable.

Figure 3:
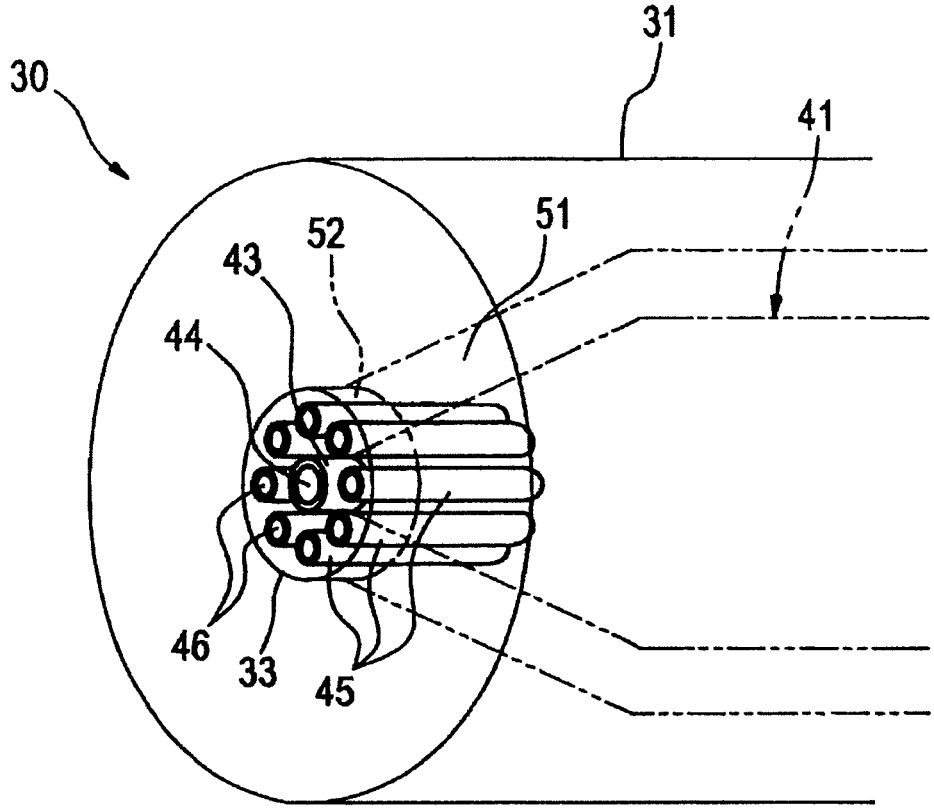
FIG. 3 is a perspective view of a primary portion of an extruder which is used in a manufacturing method of a coaxial cable according to the present invention.

The coaxial cable of the present invention may be manufactured by using an extruder 30 in which a die 31 and a point 41 shown in FIG. 3 are combined.

The same number of members 45, each having a cylindrical outer shape, as the void portions are provided to the point 41, and the point 41 is combined with the die 31 having a circular outlet 33, whereby resin is extruded from between the point 41 and the die 31 (through flow passages 51, 52). A central conductor is drawn out of a center hole 44 of a cylindrical portion 43 of the point 41. The central conductor 12 is covered with the extruded resin. The covering with resin may be implemented by a drawing down method in which resin that is extruded from the outlet of the die 31 is stretched to reduce its diameter and is drawn down. No resin flows through the cylindrical members 45, whereby void portions are formed at the corresponding portions. When air holes 46 are provided in the respective members 45, the void portions, where the resin does not flow, are provided in the resin extruded from the die 31, and an a cross section thereof becomes circular or elliptical.

While the coaxial cable described above is explained as an example of a single-core cable, a multicoaxial cable may be provided by bundling a plurality of the coaxial cables or by further shielding with a common shield conductor.

To evaluate the above-described coaxial cable according to the present invention, samples of Examples of the present invention and Comparative Examples were manufactured and tested. In the samples of Examples 1 and 2 and Comparative Examples 1-4, a stranded wire in which seven silver-coated annealed copper strands having an outer diameter of 0.127 mm was used as a central conductor, and was covered with an extruded fluororesin (FEP) as an insulator having an outer diameter of 0.94 mm. When extruding the insulator, the jig as shown in FIG. 3 was used for forming void portions, and the void portions continuing in the longitudinal direction were formed inside the insulator. The size and the number of the void portions were as described below in the respective Examples. A tin-coated annealed copper wire was braided in a single layer as an outer conductor, and was covered with an extruded fluororesin (PFA) to obtain a coaxial cable of having an outer diameter of 1.35 mm.

Example 1

Eight void portions, each having a diameter of 0.20 mm, were provided. The void ratio per each of the void portions was 5.4%, and the total void ratio was 43%.

Example 2

Eight void portions, each having a diameter of 0.224 mm, were provided. The void ratio of each of the void portions was 6.8%, and the total void ratio was 54%.

Comparative Example 1

Eight void portions, each having a diameter of 0.230 mm, were provided. The void ratio of each of the void portions was 7.2%, and the total void ratio was 57%.

Comparative Example 2

Six void portions, each having a diameter of 0.234 mm, were provided. The void ratio of each of the void portions was 7.4%, and the total void ratio was 44%.

With respect to each of the sample coaxial cables described above, the following tests were conducted.

(1) Crush test

The coaxial cable was pressed with a 5 mm-square flat face on a tip of a push-pull gauge, and force that changed the characteristic impedance by 2Ω was measured.

(2) Winding test

Five turns of winding was carried out on a 4 mm-diameter mandrel, and a variation (difference) in characteristic impedance before and after the winding was measured.

(3) Twist test

The coaxial cable was twisted five times in a 10 mm-range, and a variation (difference) in characteristic impedance before and after the twisting was measured.

(4) Kink test

The coaxial cable was kinked, and a variation (difference) in characteristic impedance before and after the kinking was measured.

Test results are shown in the table below.

TABLE 1

| | Example 1 | Example 2 | Com. Example 1 | Com. Example 2 |
|---|---|---|---|---|
| Number of Voids | 8 | 8 | 8 | 6 |
| Diameter of Void | 0.200 mm | 0.224 mm | 0.230 mm | 0.234 mm |
| Void Ratio per Each | 5.4% | 6.8% | 7.2% | 7.4% |
| Total Void Ratio | 43% | 54% | 57% | 44% |
| Crush Test (n = 6) | 3.47 kg | 2.77 kg | 1.80 kg | 1.75 kg |
| Winding Test (n = 2) | 2.0 Ω | 4.0 Ω | 6.0 Ω | 6.5 Ω |
| Twist Test (n = 2) | 4.5 Ω | 7.0 Ω | 10.0 Ω | 10.0 Ω |
| Kink Test (n = 2) | 1.0 Ω | 2.0 Ω | 3.5 Ω | 3.5 Ω |

In the crush test, in general, it is required to withstand a force of 2.0 kg or more. Assuming that the test is passed if the force that caused the 2Ω variation of impedance is 2.0 kg more, both of the samples of Examples in which the void ratio per each was 6.8% or less passed the test, while both of the samples of Comparative Examples in which the void ratio per each 7.2% or more did not pass the test. Further, in each of the winding test, the twist test, and the kink test, the samples of Examples showed smaller impedance variations and hence were more durable against winding, twisting, and kinking than the samples of Comparative Examples.

In addition, the following samples of Comparative Examples were manufactured, and were compared with the samples of Examples.

Comparative Example 3

According to a coaxial cable in which the number of voids was six, the void ratio per each was 6.5%, the total void ratio was 39%, and the materials and the dimensions of the central conductor and the insulator were made the same as the samples of Examples, the impedance was smaller than 50Ω, and were defective.

Comparative Example 4

According to a coaxial cable in which a shape of a void was fan-shaped as shown in (A) of FIG. 2, and the void ratio per each was 6.8%, it sometimes did not withstand the force of 2.0 kg in the crush test (i.e., the impedance was varied by 2Ω with a force of less than 2.0 kg), so non-defective yield is low. On the other hand, all the samples of Examples in which the cross section of each of the void portions is circular or elliptical and the void ratio per each is 6.8% or less passed the crush test.

Coaxial cables in which the central conductor was made thinner so that the diameter of the insulator relative to the diameter of the central conductor was made larger were manufactured in the following manner. A stranded wire in which seven silver-coated silver-copper alloy strands, each having an outer diameter of 0.025 mm, was used as a central conductor, and was covered with an extruded fluororesin (PFA) as an insulator having an outer diameter of 0.29 mm. The diameter of the insulator was 3.9 times the diameter of the central conductor. When extruding the insulator, the jig for forming void portions was used to form the void portions continuing in the longitudinal direction inside the insulator. The size and the number of the void portions were as described below. A tin-coated annealed copper wire was braided in a single-layer as an outer conductor, and was covered with an extruded fluororesin (PFA) to obtain a coaxial cable having an outer diameter of 0.42 mm.

Example 3

Diameter of Void Portion: 0.084 mm
Number of Void Portions: 6
Void Ratio per Each Void Portion: 9.0%
Total Void Ratio: 54%

Example 4

Diameter of Void Portion: 0.088 mm
Number of Void Portions: 6
Void Ratio per Each Void Portion: 10%
Total Void Ratio: 60%

Comparative Example 5

Diameter of Void Portion: 0.074 mm
Number of Void Portions: 8
Void Ratio per Each Void Portion: 7.0%
Total Void Ratio: 56%

Comparative Example 6

Diameter of Void Portion: 0.070 mm
Number of Void Portions: 8
Void Ratio per Each Void Portion: 6.3%
Total Void Ratio: 50%

In Examples 3 and 4, coaxial cables whose capacitance is 60 pF/m or less were able to be manufactured.

In Comparative Example 5, the insulation between void portions was broken and the coaxial cable was collapsed during manufacture (when winding the cable) and, thus, was defective.

In Comparative Example 6, a coaxial cable was able to be manufactured. However, with this size (the diameter of the insulator/the diameter of the central conductor), the capacitance could not be reduced to 60 pF/m.

With respect to the diameter of the central conductor described above, the diameter of the insulator may be slightly smaller or larger than in the Examples described above. The diameter of the insulator may be 3.2 to 4.0 times the diameter of the central conductor. In this case, when a set of six void portions are provided, the void ratio per each is 9.0% to 10%, and the total void ratio is 54% to 60%, coaxial cables whose capacitance is 60 pF/m or less can be obtained.

While the present invention has been described in detail and with reference to a certain embodiment, it is apparent to those skilled in the art that various changes and modifications may be made therein without departing from the spirit and scope of the present invention. This application is based on Japanese Patent Application (No. 2008-244033) filed on Sep. 24, 2008, the content of which is incorporated herein by reference.

EXPLANATION OF REFERENCE NUMERALS

11 . . . Coaxial cable, 12 . . . Central conductor; 13 . . . Insulator, 14 . . . Void Portions, 15 . . . Outer Conductor, 16 . . . Jacket

The invention claimed is:

1. A coaxial cable comprising:

an insulator having void portions continuing in a longitudinal direction;

a central conductor covered with the insulator; and an outer conductor arranged on an outer circumference of the insulator, wherein:

each of the void portions is formed to have a circular or elliptical cross section, the void portions are evenly arranged in the insulator in a set of eight, in a cross section perpendicular to the longitudinal direction of the coaxial cable, a void ratio of each of the void portions is 6.8% or less, and a void ratio of the entire void portions is 43% to 54%, where the void ratio of the entire void portions is a proportion of the void portions to a sum of a total area of all the void portions and an area of the insulator, and a ratio of a diameter of the insulator to a diameter of the central conductor is 2.4 to 2.7.

2. The coaxial cable according to claim 1, wherein the outer conductor is formed by arranging a bare copper wire, a silver-coated or tin-coated annealed copper wire, or a copper alloy wire on the outer circumference of the insulator in a spirally-wound structure.

3. A coaxial cable comprising:

an insulator having void portions continuing in a longitudinal direction:

a central conductor covered with the insulator; and an outer conductor arranged on an outer circumference of the insulator, wherein:

each of the void portions is formed to have a circular or elliptical cross section, the void portions are evenly arranged in the insulator in a set of six, in a cross section perpendicular to the longitudinal direction of the coaxial cable, a void ratio of each of the void portions is 9.0% to 10%, where the void ratio of the each of the void portions is a proportion of the each of the void portions to a sum of a total area of all the void portions and an area of the insulator, a ratio of a diameter of the insulator to a diameter of the central conductor is 3.2 to 4.0, and a capacitance of the insulator is 60 pF/m or less.

4. The coaxial cable according to claim 3, wherein the outer conductor is formed by arranging a bare copper wire, a silver-coated or tin-coated annealed copper wire, or a copper alloy wire on the outer circumference of the insulator in a spirally-wound structure.

5. A multicoaxial cable comprising a plurality of coaxial cables, each of the coaxial cables comprising:

an insulator having void portions continuing in a longitudinal direction;

a central conductor covered with the insulator; and an outer conductor arranged on an outer circumference of the insulator, wherein:

each of the void portions is formed to have a circular or elliptical cross section, the void portions are evenly arranged in the insulator in a set of eight, in a cross section perpendicular to the longitudinal direction of the coaxial cable, a void ratio of each of the void portions is 6.8% or less, and a void ratio of the entire void portions is 43% to 54%, where the void ratio of the entire void portions is a proportion of the void portions to a sum of a total area of all the void portions and an area of the insulator, and a ratio of a diameter of the insulator to a diameter of the central conductor is 2.4 to 2.7.

6. A multicoaxial cable comprising a plurality of coaxial cables, each of the coaxial cables comprising:

an insulator having void portions continuing in a longitudinal direction;

a central conductor covered with the insulator; and an outer conductor arranged on an outer circumference of the insulator, wherein:

each of the void portions is formed to have a circular or elliptical cross section, the void portions are evenly arranged in the insulator in a set, in a cross section perpendicular to the longitudinal direction of the coaxial cable, a void ratio of each of the void portions is 9.0% to 10%, where the void ratio of the each of the void portions is a proportion of the each of the void portions to a sum of a total area of all the void portions and an area of the insulator, a ratio of a diameter of the insulator to a diameter of the central conductor is 3.2 to 4.0, and a capacitance of the insulator is 60 pF/m or less.

* * * * *

UNITED STATES PATENT AND TRADEMARK OFFICE

CERTIFICATE OF CORRECTION

PATENT NO. : 8,455,761 B2
APPLICATION NO. : 12/682437
DATED : June 4, 2013
INVENTOR(S) : Hayashishita et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 218 days.

Signed and Sealed this
Eighth Day of September, 2015

Michelle K. Lee

Michelle K. Lee
*Director of the United States Patent and Trademark Office*